US006224153B1

(12) United States Patent
Vodinh

(10) Patent No.: US 6,224,153 B1
(45) Date of Patent: May 1, 2001

(54) FOLDING SEAT ASSEMBLY

(75) Inventor: Hien Vodinh, Knoxville, TN (US)

(73) Assignee: Senior Industries, Inc., Wood Dale, IL (US)

( * ) Notice: Subject to any disclaimer, the term of this patent is extended or adjusted under 35 U.S.C. 154(b) by 0 days.

(21) Appl. No.: 09/349,757

(22) Filed: Jul. 8, 1999

(51) Int. Cl.[7] ..... A47C 1/00

(52) U.S. Cl. ..... 297/331; 297/14; 297/195.11; 297/244; 248/240

(58) Field of Search ..... 297/331, 337, 297/195.11, 14, 244, 463.1; 108/152; 248/240

(56) References Cited

U.S. PATENT DOCUMENTS

| | | | | |
|---|---|---|---|---|
| 600,462 | * | 3/1898 | Upham | 248/240 X |
| 763,281 | | 6/1904 | Hales . | |
| 859,454 | * | 7/1907 | Larsson | 248/240 X |
| 970,777 | * | 9/1910 | Ackerman | 248/240 X |
| 1,355,005 | * | 10/1920 | Schechter | 297/14 X |
| 1,506,240 | | 8/1924 | Ives . | |
| 1,692,930 | * | 11/1928 | Cummings | 297/14 |
| 1,761,673 | * | 6/1930 | Laursen | 297/14 |
| 1,784,390 | * | 12/1930 | Rice | 297/14 X |
| 2,394,203 | | 2/1946 | Pruder . | |
| 2,675,056 | * | 1/1954 | Bell | 297/195.11 |
| 3,073,560 | | 1/1963 | Montgomery . | |
| 3,131,964 | * | 5/1964 | Reed | 248/240 X |
| 3,392,802 | | 7/1968 | Moore . | |
| 3,990,537 | | 11/1976 | Swenson | 108/152 |
| 4,113,058 | | 9/1978 | Kobosh | 108/152 X |
| 4,129,198 | * | 12/1978 | Hunter | 108/152 X |
| 4,600,081 | | 7/1986 | Wade | 108/152 X |
| 4,625,833 | | 12/1986 | Lewis | 108/152 X |
| 4,721,183 | | 1/1988 | Koniecka | 108/152 X |
| 4,799,632 | * | 1/1989 | Baymak et al. | 297/244 X |

FOREIGN PATENT DOCUMENTS

| | | | | |
|---|---|---|---|---|
| 86746 | * | 1/1956 | (NO) | 248/240 |

* cited by examiner

*Primary Examiner*—Peter M. Cuomo
*Assistant Examiner*—Rodney B. White
(74) *Attorney, Agent, or Firm*—Ronald L. Wanke; Jenner & Block

(57) ABSTRACT

A folding seat assembly is attachable to the upright vertical post for a tennis net and consists of a pair of interchangeable clamp brackets secured around the vertical post. An upper elongated tube is pivotally mounted to the upper clamp bracket and is slidably mounted to a bottom seat guide. A lower elongated tube is pivotally connected to the bottom clamp bracket and is pivotally connected to the bottom seat assembly to create a triangular support for the seat. A second seat can extend from the opposite side of the same pair of clamp brackets. The seat(s) are maintained in a vertical inactive position by an over-center arrangement and a detent mechanism.

24 Claims, 2 Drawing Sheets

FOLDING SEAT ASSEMBLY

FIELD OF THE INVENTION

This invention relates to a folding seat securable to an upright vertical post as is used in various sports such as tennis, and particularly to a folding seat for supporting substantial weight and having a stowable position substantially parallel to the vertical post to minimize any obstructions.

BACKGROUND OF THE INVENTION

A variety of sports such as tennis include one or more upright vertical posts for supporting a net or ropes associated with that sport. During rest times, a player may desire to rest on a folding seat. However, the presence of folding chairs and stools and the like are undesirable as these devices must be removed from the playing field while the game is in progress. Various folding seats have been proposed which attach to vertical posts but these have not been widely adopted for a variety of reasons.

A folding seat which would be practical for use on a tennis court or the like must solve a variety of conflicting requirements. During a tennis match, the seat should be collapsible into a position having minimal impact with the play of the game. Furthermore, it should not interfere with cleaning and washing of a tennis court and other maintenance functions. In addition, it desirably would have minimum permanent impact on the tennis net posts and should be capable of removal when necessary. In use, the seat should be capable of supporting substantial weight without unnecessary strain on the tennis net post as might be caused by a cantilever seat or the like. Furthermore, it would be desirable to allow players on both sides of the tennis court to be able to simultaneously use a seat arrangement without creating any unnecessary imbalance or strain on the pre-existing tennis net post.

SUMMARY OF THE INVENTION

In accordance with the present invention, the disadvantages of prior folding seats usable with an upright vertical post for a sports game have been eliminated. A folding seat is provided for an upright post which has minimal impact in its stowed position and can support substantial weight, including one or more players, where in an active position. These desirable features are available in a folding seat assembly which can be economically manufactured while being of rugged construction and capable of outdoor and indoor use.

One object of the present invention is to provide a folding seat usable with an upright vertical post and having a stowed position of minimal impact and an active position using a triangular support mechanism of simple yet rugged construction.

Another object of this invention is to provide a folding seat for a sports game such as tennis in which the seat mechanism can be secured to a vertical post without permanent damage. Furthermore, the folding seat is capable of supporting multiple users at one time, and also minimizes disadvantages in its stowed position compared to prior folding seats used with sporting events.

Further advantages and objects of the invention will be apparent from the following description and from the drawings.

DESCRIPTION OF THE PREFERRED EMBODIMENTS

Figure 1:
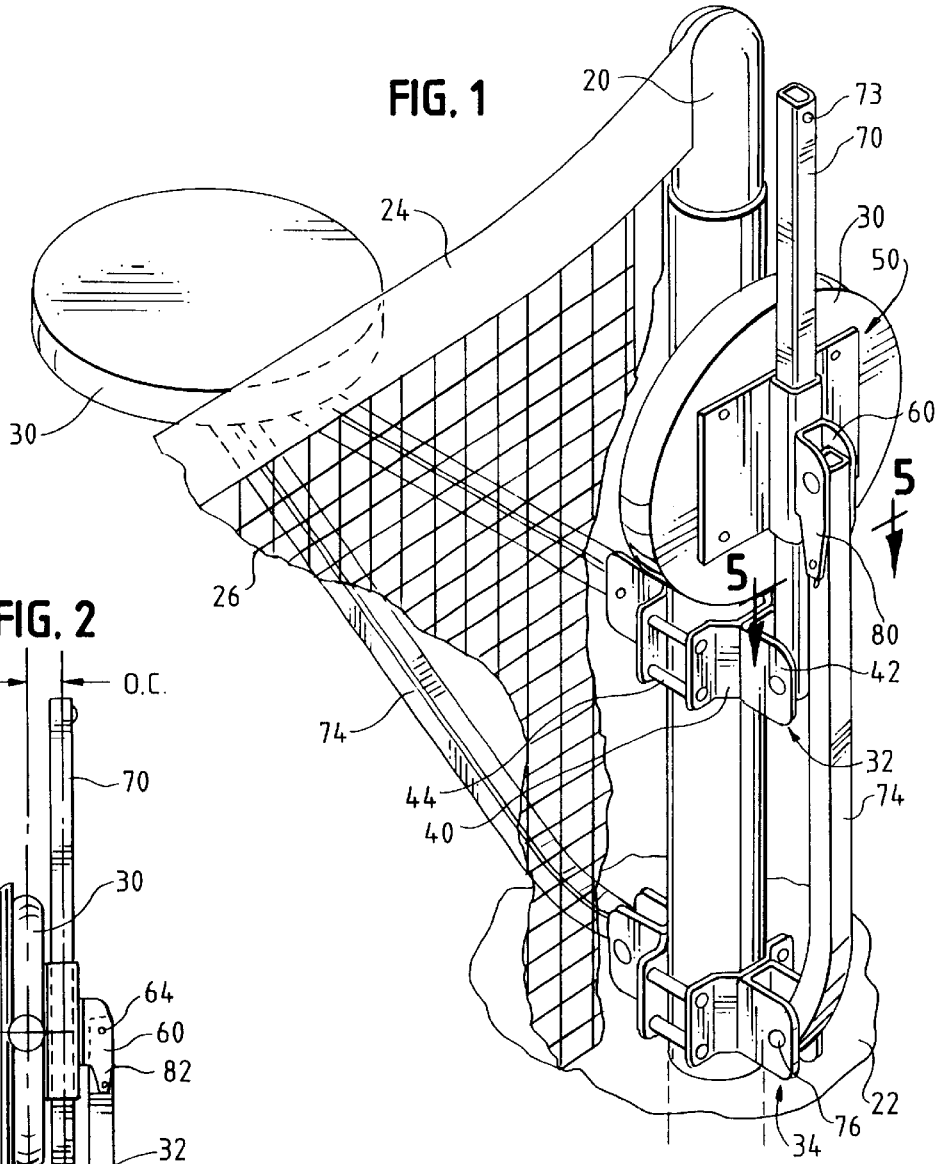
FIG. 1 is a perspective view of a novel folding seat assembly as attached to an upright vertical post for a tennis net, and illustrates one seat in an active position and another seat in a stowed position.
Figure 2:
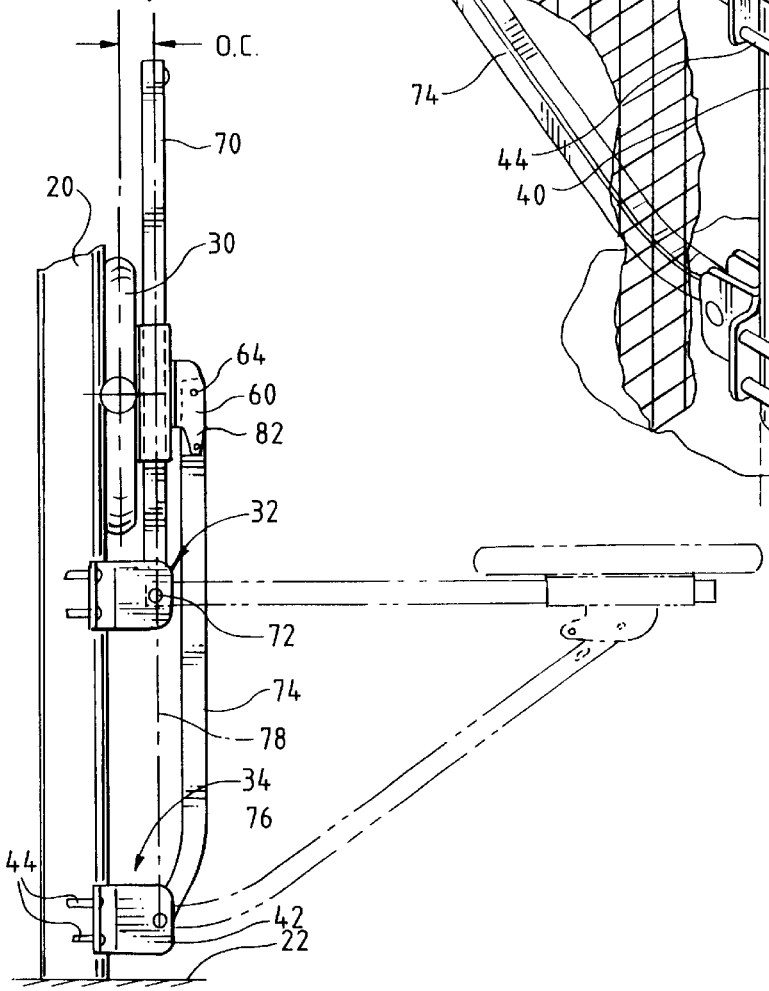
FIG. 2 is a side view in solid lines showing the stowed seat illustrated in FIG. 1, and including in dashed lines the seat when lowered to an active position.

As illustrated in FIGS. 1 and 2, a novel folding seat assembly has been particularly designed for use in connection with sporting events such as tennis. An upright net post 20 extends vertically above a tennis playing field 22 into which the vertical post 20 is permanently secured. The post 20 supports a net rope or cord 24 which suspends a tennis net 26 above the tennis court 22.

The novel folding seat assembly consists of a pair of cylindrical seats 30 located on opposite sides of the upright vertical post 20, and each independently movable between a stowed vertical position (as illustrated for the rightmost seat in FIG. 1) and a lowered or active horizontal position (as illustrated for the leftmost seat 30 in FIG. 1). To support the pair of seats 30, an upper bracket assembly 32 is clamped around the post 20 at a vertical height approximately equal to the desired height for the seats 30 when in use in their horizontal positions. A lower bracket assembly 34 is clamped around the upright post 20 at a lower spaced position which is near, but slightly spaced above, the playing field 22. The lower bracket assembly 34 is desirably located slightly above the playing field 22 to allow the tennis court to be washed or otherwise cleaned and maintained and desirably does not contact the playing surface 22. For economical manufacture and to provide interchangeable parts, the upper and lower bracket assemblies 32 and 34 are desirably formed of identical components.

Each of the bracket assemblies 32 and 34 form a pivot mechanism, as will appear, and include two post support plates 40 which have a center indent to partially surround the round upright post 20. At the exterior side of the indented center portion, a U-shaped hinge bracket 42 is welded and extends outwardly. Each side of the support bracket 40 has a pair of apertures which receive a pair of threaded fasteners 44 such as a bolt and nut which extend through the support plate 40 to clamp the pair of plates 40 securely against the vertical post 20. Each bolt 44 has an enlarged head with a screw slot, and a threaded nut on the opposite end, to allow the pair of opposite plates 40 to be securely tightened together in order to clamp against the post 20. The bracket assemblies can be removed if desired without any adverse impact on the vertical post 20. It is preferred that the bracket assemblies 32 and 34 be externally clamped around the vertical post 20 as this prevents the need for drilling or permanent alteration to the vertical tennis post. However, it is possible for the brackets 32 and 34 to be secured by through-bolts extending through holes drilled through the vertical tennis post 20 if desired.

Figure 3:
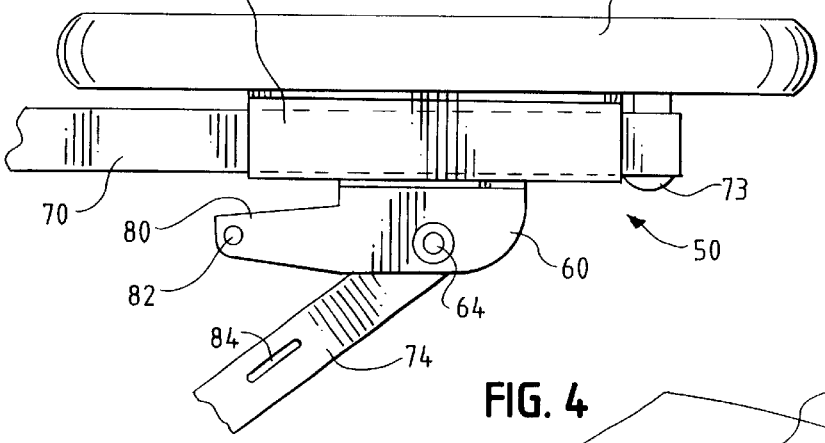
FIG. 3 is an enlarged side view of a portion of the seat assembly of FIGS. 1 and 2 when lowered to an active position.
Figure 4:
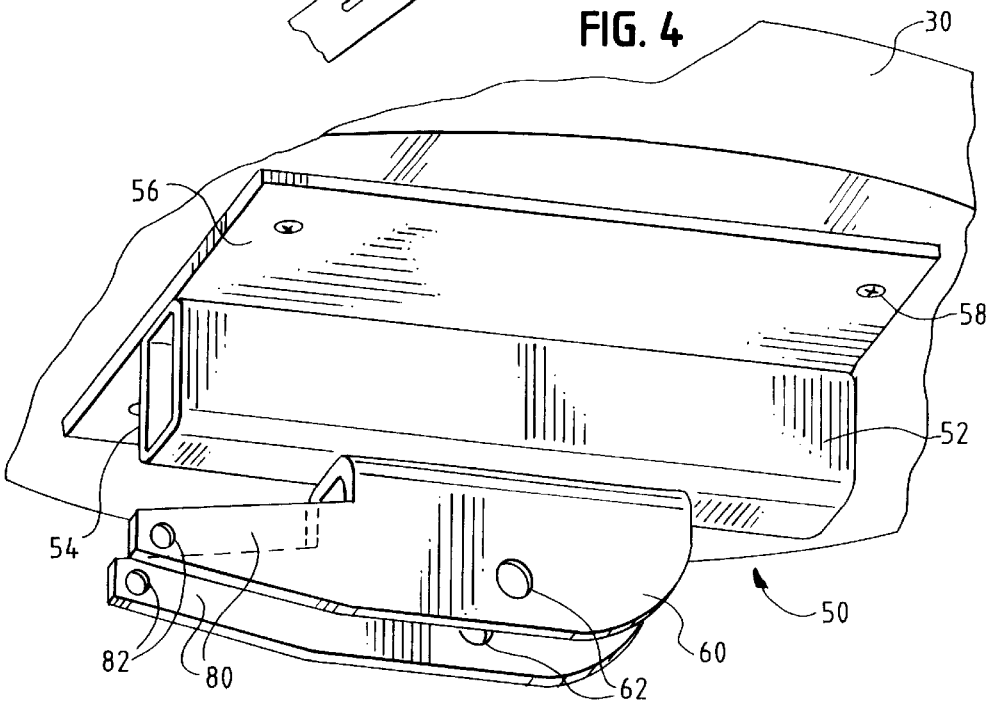
FIG. 4 is a further enlarged and perspective view of a bottom portion of the seat plate assembly.

Each seat 30 has secured to its bottom a seat assembly 50 illustrated in more detail in FIGS. 3–4. A sliding guide member 52 in the form of a hollow metal tube having a generally square cross-section 54 is welded to a rectangular metal seat plate 56. Seat plate 56 has four apertures through which fasteners such as screws 58 secure the plate to the circular seat 30 which can be formed of wood or plastic or composite material. A generally U-shaped hinge bracket 60 is welded to the bottom of the guide tube 52 and includes a pair of apertures 62 for mounting therein a pivot pin 64, see FIG. 3.

An upper elongated support member 70, see FIGS. 1–3, is formed of a straight shaft or a straight tube (either solid or hollow) of generally square cross section. It can be formed of extruded carbon steel hollow tubing such as 0.125 inches thick and having a powder coating for smoothness and corrosion protection, or alternatively could be a solid rod. One end of the elongated tube is movably secured to the upper bracket assembly 32 by a pivot pin 72 which extends through the U-shaped hinge bracket 42 to pivotally mount tube 70 thereto. At its other end portion, the elongated tube 70 is slidably movable within the hollow guide tube 52 of the seat assembly 50 and freely moves or slides within the tube 52. At its distal end, a stop pin 73 prevents further sliding movement within the guide tube 52 when the seat 30 is fully lowered to its active horizontal position.

A lower elongated support member 74 in the form of a rod or a metal tube (either hollow or solid) extends between the lower post bracket assembly 34 and the seat assembly 50. The tube 74 may be formed of similar material to tube 70, but is curved at its lower end where it is secured by a pivot pin 76 to the hinge bracket 42 of the lower bracket assembly 34. At its other distal end, the tube 74 is secured by the pivot pin 64 to the hinge bracket 60 of the seat assembly 50. As a result, the lower tube 74 is pivotally connected for rotation movement at both ends, in contrast to the upper support tube 70 which is pivotally connected at the post end but slidably connected to the seat assembly.

In the stowed or upright vertical position for the seat 30, the pair of elongated support tubes 70 and 74 are offset from and generally parallel with each other and are parallel to the upright vertical post 20, as seen in FIGS. 1 and 2. A center line 78 for the elongated upper tube 70 when in its vertical position desirably extends through the upper pivot pin 72 and the lower pivot pin 76, as seen in FIG. 2. This can be accomplished because the lower tube 74 is curved at its lower end and extends outwardly so as to not interfere with the upper tube 70 when the seat assembly is in its stowed position. In this position, the seat 30 is over-center or off-center with respect to its pivot point of rotation as illustrated by the dashed lines labeled "O.C." in FIG. 2. Because the seat 30, which may be formed of wood, can be heavier than the metal hinge bracket 60 which extends on the other side of the center line 78 (and which has a friction fit and also is partially supported by the lower tube 74), the seat assembly will tend to remain upright in a stowed position as illustrated in FIG. 2 until lowered for use.

Figure 5:
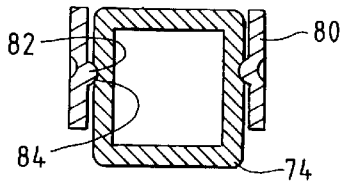
FIG. 5 is a cross-sectional view taken along lines 5—5 of FIG. 1 and illustrating a detent mechanism for the seat assembly.

While not essential, a snap-fit detent mechanism can be provided to further ensure that the seat assembly remains upright when not in use even if there is some dislodging force, such as a tennis ball striking a portion of the seat assembly. As seen best in FIGS. 3–5, the hinge bracket 60 has a pair of extending legs 80 which can deflect under pressure. The legs contain inwardly projecting detent dimples 82. The lower support tube 74 has a pair of elongated grooves 84 pressed into the cross section of the generally square tube 74 for receiving the dimples 82 of the seat assembly in order to form a snap-fit detent mechanism to further positively lock the seat in the upright position when stowed vertically as illustrated in FIGS. 1 and 2.

In its stowed or vertically upright position, the upper and lower support tubes 70 and 74 are generally vertical and parallel to each other and to the vertical post 20. The stowed seat 30 is desirably located over-center from the center line 78. Furthermore, the detent mechanism formed by the detent legs 80 and dimples 82 within the grooves 84 of the lower tube 74 tends to further maintain the seat in its stowed position. When viewed from the far serving position of the tennis court, the vertical tubes 70 and 74 in the inactive seat position will generally blend in with the tennis post 20, and the entire folding seat assembly provides minimal obstruction on the tennis court.

When it is desired to use the seat, a player can move the seat 30 outwardly away from the tennis post 20 to thereby release the snap-fit detent mechanism. The seat assembly 50 will slide within the upper tube 70 until the seat 30 reaches a horizontal position as illustrated in the left portion of FIG. 1 and in the dashed lines in FIG. 2. In this position, the pair of support tubes 70 and 74 desirably form a triangular shape with the vertical post 20 in order to support substantial weight on the seat. Preferably, the upper support tube 72 forms a right triangle with the vertical post 20, and the lower support tube 74 has a substantial skew as seen in the dashed lines in FIG. 2 in order to transfer weight from the seat to the lower portion of the vertical post 20 adjacent where it is fixedly secured to the playing field 22. Because the seat 30 in its extended position is not cantilevered, but has substantial support through the triangular frame mechanism formed by the pair of tubes 70 and 74 and post 20, substantial weight can be supported on each side of the post 20.

If desired, two seats in tandem can be located on each side of the support post 20 so that four seats are provided for two players on each side of the tennis court. It is preferred that the lower tube 74 extend to the outward-most seat to support the weight of the players. Alternatively, one of the pair of seats 30 seen in FIG. 1 can be eliminated so that a single seat is formed. In such an event, the post support plate 40 and hinge bracket 42 can be eliminated on the opposite side of both bracket assemblies 32 and 34 and the plate, bracket and four bolts 44 can be replaced with a pair of U-bolts which surround the post 20 and are secured at the ends with nuts so that only a single support plate and hinge bracket is provided on each assembly 32 and 34 for the single seat. Other lock mechanisms than the detent mechanism can be used to retain the seat vertically and/or horizontally as desired. Various other modifications will be apparent to those of skill in the art.

What is claimed is:

1. A folding seat attachable to an upright post, comprising:

a first pivot assembly attachable to the upright post, a second pivot assembly attachable to the upright post at a spaced distance from the first pivot assembly, a seat assembly including a seat and a guide member for allowing slidable movement, a first elongated support member pivotally attached to the first pivot assembly and slidably movable with respect to the guide member to move the seat assembly along the first elongated support member as the first elongated support member is pivoted upwardly, a second elongated support member pivotally attached to the second pivot assembly and movably attached to the seat assembly to fixedly support the seat assembly when in a lowered position for use.

2. The folding seat of claim 1 wherein the second elongated support member is pivotally attached to the seat assembly to thereby cause the seat assembly to slide along the first elongated support member toward the first pivot assembly as the seat assembly is raised upwardly.

3. The folding seat of claim 1 wherein the guide member comprises a hollow member which surrounds the first elongated support member to slidably capture the first elongated support member within the hollow member.

4. The folding seat of claim 3 wherein the hollow member comprises an elongated hollow tube, and the first elongated support member is pivotally attached to the first pivot assembly and slidably movable inside of the elongated hollow tube.

5. The folding seat of claim 1 including a detent mechanism associated with one of the first and second elongated support members for maintaining the members and seat assembly in a raised position.

6. The folding seat of claim 5 wherein the detent mechanism comprises a first detent member on the seat assembly and a mating second detent member on one of the first and second elongated support members for capturing the one support member when in a raised position.

7. The folding seat of claim 6 wherein the second detent member comprises a detent surface near a portion of the second elongated support member which is movably attached to the seat assembly for receiving a first movable detent member on the seat assembly.

8. The folding seat of claim 1 wherein the first pivot assembly and the second pivot assembly are formed of interchangeable components.

9. The folding seat of claim 1 wherein the first pivot assembly and the second pivot assembly each comprise a clamping plate which clamps around the upright post, and a projecting flange mounting a pivot pin attachable to each of the elongated support members to thereby pivotally attach each elongated support member to its respective pivot assembly.

10. A folding seat attachable to a vertical post, comprising:

an upper bracket assembly for clamping around the vertical post, a lower bracket assembly which clamps around the vertical post at a position below the upper bracket assembly, a seat assembly including a seat having a horizontal active position when in use and a vertical inactive position, and at least two securing members on a bottom portion of the seat, an upper elongated member movably attachable to the upper bracket assembly and movably attachable to one of the securing members for allowing movement between the vertical position and the horizontal position, a lower elongated member movably attachable to the lower bracket assembly and movably attachable to the other of the securing members for allowing movement between the vertical position and a substantially skewed position to form a generally triangular shape with the upper elongated member when in the horizontal position and the vertical post.

11. The folding seat of claim 10 wherein the upper bracket assembly and the lower bracket assembly are formed of interchangeable parts.

12. The folding seat of claim 10 wherein each of the upper bracket assembly and lower bracket assembly include a clamping plate which can be secured around the vertical post and a projecting flange for pivotally attaching a respective elongated member to a respective bracket assembly.

13. The folding seat of claim 12 wherein the flange comprises a generally U-shaped member which surrounds the respective elongated member and a pivot pin extending through the respective elongated member to pivotally capture the respective elongated member.

14. The folding seat of claim 12 wherein each bracket assembly includes a pair of clamp plates for partially surrounding the vertical post and a threaded fastener extending between the pair of clamp plates for securely clamping the pair of clamp plates around the vertical post.

15. The folding seat of claim 10 wherein the securing members on the bottom portion of the seat includes a sliding guide member for capturing and allowing sliding movement of one of the upper and lower elongated members.

16. The folding seat of claim 15 wherein the sliding guide member comprises an elongated hollow tube secured to the bottom portion of the seat for slidably receiving therein the upper elongated member.

17. The folding seat of claim 16 wherein the securing members also include a pivot assembly which pivotally connects to the lower elongated member, whereby the end portions of the lower elongated member are pivotally attached to the lower bracket assembly and the seat assembly.

18. The folding seat of claim 10 wherein the seat assembly further includes a detent mechanism which engages one of the upper and lower elongated members when in the vertical position to retain the folding seat in the vertical position.

19. The folding seat of claim 10 wherein the upper elongated member comprises a straight shaft, and the lower elongated member comprises a shaft curved where attached to the lower bracket assembly and a straight section which is substantially parallel to the upper elongated shaft when the seat assembly is in the vertical position.

20. The folding seat of claim 10 including a second seat assembly having a second seat with a horizontal active position when in use and a vertical inactive position and at least two securing members on a bottom portion of the second seat, a second upper elongated member movably attachable to the upper bracket assembly opposite the movable attachment to the first named upper elongated member, and a second lower elongated member movably attachable to the lower bracket assembly opposite the first named lower elongated member and securable to the second seat assembly, whereby a pair of seats extend outwardly in opposite directions from the upper and lower bracket assembly.

21. A folding seat assembly attachable to an upright vertical post, comprising:

an upper bracket assembly attachable to the upright post, a lower bracket assembly attachable to the upright post at a distance below the upper bracket assembly, wherein the upper bracket assembly and the lower bracket assembly are formed of interchangeable components, a first seat assembly including a first seat having a horizontal active position and a vertical inactive position, including a first set of elongated frame members movably attached to the upper and lower bracket assemblies for allowing movement between the horizontal and vertical positions, and a second seat assembly including a second seat having a horizontal active position and a vertical inactive position, including a second set of elongated frame members movably attached to the upper and lower bracket assemblies for allowing movement independent of the first seat between the horizontal and vertical positions.

22. A folding seat assembly attachable to an upright vertical post, comprising:

an upper bracket assembly attachable to the upright post, a lower bracket assembly attachable to the upright post at a distance below the upper bracket assembly, a first seat assembly including a first seat having a horizontal active position and a vertical inactive position, including a first set of elongated frame members movably attached to the upper and lower bracket assemblies for allowing movement between the horizontal and vertical positions, and a second seat assembly including a second seat having a horizontal active position and a vertical inactive position, including a second set of elongated frame members movably attached to the upper and lower bracket assemblies for allowing movement independent of the first seat between the horizontal and vertical positions, wherein the upper bracket assembly includes a pair of pivot brackets extending outwardly from opposite sides of the upper bracket assembly and respectively connectable to the first set of elongated frame members and to the second set of elongated frame members for independent pivotal movement of each set of elongated frame members.

23. A folding seat assembly attachable to an upright vertical post, comprising:

an upper bracket assembly attachable to the upright post, a lower bracket assembly attachable to the upright post at a distance below the upper bracket assembly, a first seat assembly including a first seat having a horizontal active position and a vertical inactive position, including a first set of elongated frame members movably attached to the upper and lower bracket assemblies for allowing movement between the horizontal and vertical positions, and a second seat assembly including a second seat having a horizontal active position and a vertical inactive position, including a second set of elongated frame members movably attached to the upper and lower bracket assemblies for allowing movement independent of the first seat between the horizontal and vertical positions, wherein each of the upper and lower bracket assemblies each include a clamping plate for clamping around the vertical post.

24. The folding seat assembly of claim 21 wherein each of the upper and lower bracket assemblies include projecting flanges mounting pivot pins attachable to the respective first set and second set of elongated frame members for pivoting movement of the sets of elongated frame members.

* * * * *